US011719518B2

(12) United States Patent
Macgillivray et al.

(10) Patent No.: US 11,719,518 B2
(45) Date of Patent: Aug. 8, 2023

(54) DETONATOR HAVING A MECHANICAL SHUNT

(71) Applicant: Halliburton Energy Services, Inc., Houston, TX (US)

(72) Inventors: Joseph T. Macgillivray, Fort Worth, TX (US); Christopher C. Hoelscher, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/890,608

(22) Filed: Jun. 2, 2020

(65) Prior Publication Data

US 2021/0372744 A1 Dec. 2, 2021

(51) Int. Cl.

| | |
|---|---|
| ***F42C 15/34*** | (2006.01) |
| ***F42D 1/05*** | (2006.01) |
| ***F42B 3/182*** | (2006.01) |
| ***F42B 3/103*** | (2006.01) |
| *F42C 19/06* | (2006.01) |

(52) U.S. Cl.

CPC ..... *F42B 3/182* (2013.01); *F42B 3/103* (2013.01); *F42C 15/34* (2013.01); *F42D 1/05* (2013.01); *F42C 19/06* (2013.01)

(58) Field of Classification Search

CPC .. F42B 3/18; F42B 3/182; F42B 3/103; F42C 19/06; F42C 15/34; F42D 1/05

USPC ..... 102/313, 200, 202.5, 206, 202.1, 275.11

See application file for complete search history.

(56) References Cited

U.S. PATENT DOCUMENTS

| | | | | |
|---|---|---|---|---|
| 6,385,031 | B1 | 5/2002 | Lerche et al. | |
| 8,327,764 | B2 | 12/2012 | Trousselle et al. | |
| 10,273,788 | B2 | 4/2019 | Bradley et al. | |
| 10,584,950 | B2 * | 3/2020 | Saltarelli | E21B 43/1185 |
| 10,767,453 | B2 * | 9/2020 | Phelps | F42D 1/055 |
| 11,009,330 | B2 * | 5/2021 | Saltarelli | F42C 15/34 |
| 11,078,765 | B2 * | 8/2021 | Davis | E21B 23/04 |
| 11,162,334 | B2 * | 11/2021 | Phelps | E21B 43/1185 |

(Continued)

FOREIGN PATENT DOCUMENTS

| | | | | |
|---|---|---|---|---|
| CN | 109844454 | A | 6/2019 | |
| WO | WO-2011160099 | A1 * | 12/2011 | F42D 5/00 |

(Continued)

OTHER PUBLICATIONS

International Search Report and Written Opinion in PCT/US2020/037954 dated Feb. 24, 2021.

*Primary Examiner* — Jonathan C Weber

(74) *Attorney, Agent, or Firm* — Barnes & Thornburg, LLP

(57) ABSTRACT

A detonator to activate energetic materials in downhole well environments that can be transported and operated safely. The detonator comprises a switch coupled to a power source and the energetic materials. The power source may or may not be a part of the detonator. The switch creates a default closed switch between the power source and the energetic material. The switch can communicate with an actuator in response to engaging a gun assembly. The switch can create an open switch in response to communicating with the actuator. The switch forms a short circuit when configured to the default closed switch and forms an open circuit when configured to the open switch. The energetic material is activated in response to the mechanical switch forming an open switch and power is provided by the power source.

20 Claims, 6 Drawing Sheets

(56) References Cited

U.S. PATENT DOCUMENTS

| | | | | |
|---|---|---|---|---|
| 2013/0125772 | A1* | 5/2013 | Backhus | F42D 1/05 102/206 |
| 2013/0327514 | A1 | 12/2013 | Bonavides et al. | |
| 2015/0260496 | A1* | 9/2015 | Backhus | F42D 5/00 102/311 |
| 2018/0347325 | A1 | 12/2018 | Goyeneche | |
| 2019/0212118 | A1* | 7/2019 | Saltarelli | F42C 15/34 |
| 2019/0309608 | A1* | 10/2019 | Phelps | H05K 1/119 |
| 2019/0323810 | A1* | 10/2019 | Saltarelli | F42C 15/34 |
| 2019/0390536 | A1 | 12/2019 | Archibald et al. | |
| 2020/0018584 | A1* | 1/2020 | Phelps | F42D 1/05 |
| 2020/0332630 | A1* | 10/2020 | Davis | E21B 43/119 |
| 2020/0378222 | A1* | 12/2020 | Phelps | H01R 12/714 |
| 2021/0164331 | A1* | 6/2021 | Sokolove | F42B 3/182 |
| 2021/0239444 | A1* | 8/2021 | Saltarelli | F42D 1/05 |

FOREIGN PATENT DOCUMENTS

| | | | | |
|---|---|---|---|---|
| WO | 2018055339 | A1 | 3/2018 | |
| WO | WO-2019032600 | A1 * | 2/2019 | F42B 3/182 |
| WO | WO-2019135804 | A1 * | 7/2019 | E21B 43/1185 |
| WO | WO-2019147294 | A1 * | 8/2019 | E21B 43/1185 |

* cited by examiner

DETONATOR HAVING A MECHANICAL SHUNT

BACKGROUND

Explosive charges are commonly used in perforating guns conveyed downhole into a well to create perforations (holes) through a wellbore casing or liner, to allow hydrocarbon fluids from the formation to flow into the well. The fluids can then be pumped to the surface for further processing. Safety regulations and best practices are implemented to regulate the transportation of these explosives. The explosives, detonators, and other perforating gun components may be transported between storage facilities and well sites while the detonator is in a state that prevents the explosives from being activated. Once at a well site, a user may place the detonator in a state that prepares the detonator for activation such that the detonator may be fired or triggered.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
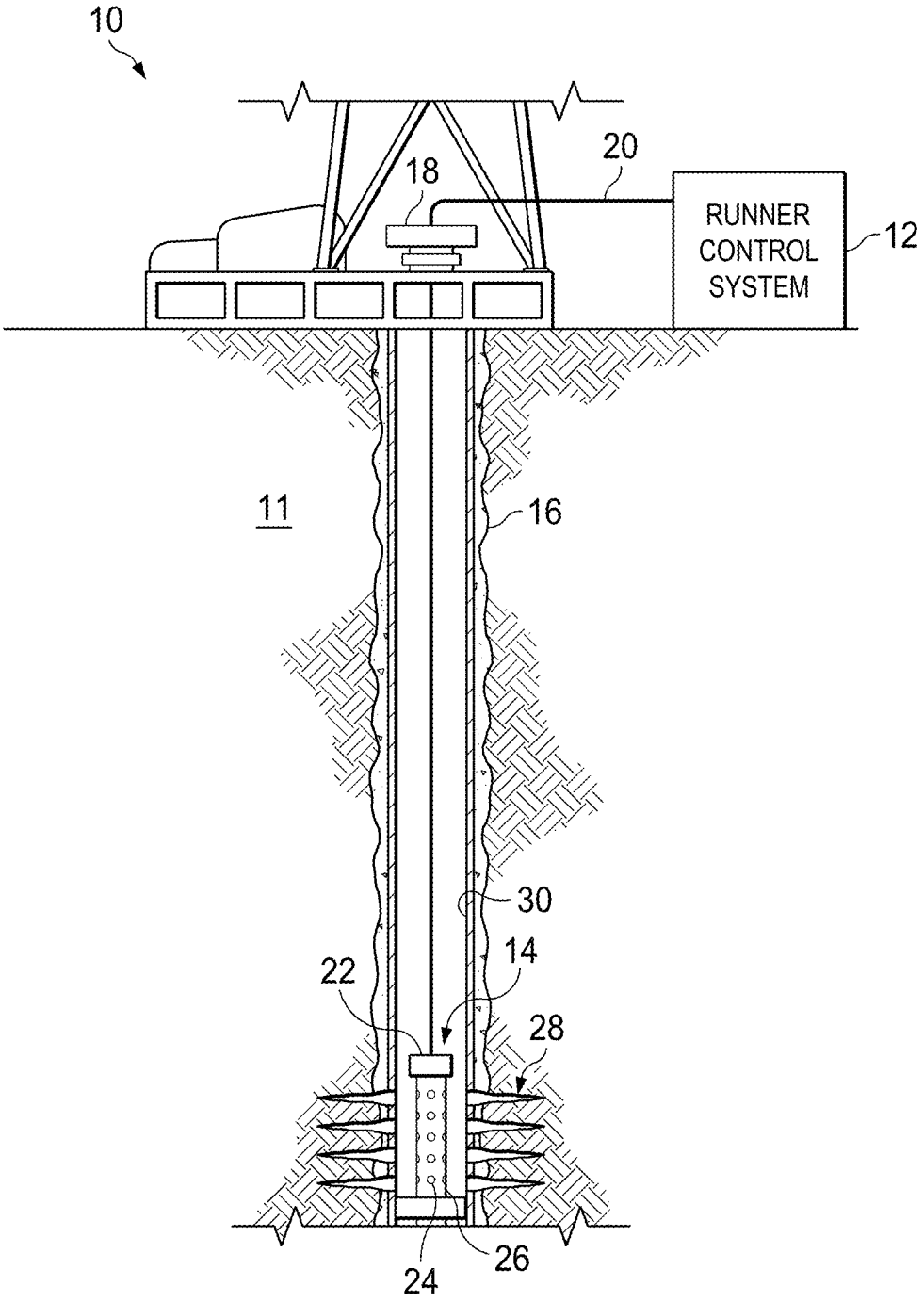
FIG. 1 is an illustration of a schematic of a well for accessing hydrocarbons in a subterranean formation.

In the following detailed description of several illustrative embodiments, reference is made to the accompanying drawings that form a part hereof. These embodiments are described in sufficient detail to enable those skilled in the art to practice the disclosed subject matter, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to a detonator for igniting an energetic material for use in a hydrocarbon well, primarily during the completion or production stages of the well. The detonator may be any type of initiation device used to initiate the activation of the energetic material. An "energetic material" as referred to herein generally includes an explosive material, but also may include other energy sources, such as pyrotechnic compositions propellants, or other materials used to perforate a casing, pipe, or tubing deployed in a well. The improved detonator comprises a mechanical shunt which is actionable between a default closed position and an open position. The position of the shunt is dependent upon engagement of the shunt by an engagement member or engagement member associated with a perforating gun in which the detonator is positioned prior to deployment downhole. Prior to placement of the detonator in the perforating gun, the engagement member does not engage the shunt, which allows the shunt to remain in the default closed position. As described in more detail herein, the shunt in the closed position provides a completed circuit that prevents a detonation signal from being transmitted to the energetic material. This closed position of the shunt is the default position since it is desired to prevent premature ignition or detonation of the energetic material. When it is desired to detonate the energetic material, the detonator is placed within the perforating gun, which may be accomplished prior to being deployed in the well. As the detonator is placed within the perforating gun, the engagement member preferably engages the shunt, and the shunt is moved to the open position. In the open position, power supplied to the detonator will no longer pass current through the shunt, but instead will pass current to the energetic material to cause detonation.

The shunt acts as a safety device which prevents power from being supplied to the energetic material when the shunt is in the default closed position. This prevents premature detonation of the detonator. When the detonator is coupled to or inserted within the perforating gun, the movement of the shunt to the open position removes the fail-safe feature, and allows detonation of the energetic material to be initiated upon the delivery of power (i.e., current) to the energetic material.

FIG. 1 illustrates a schematic of a well 10 for accessing hydrocarbons in a subterranean formation 11. Well site operation 10 includes a runner and controller system 12 for running a perforating gun 14 down a wellbore 16 through wellhead 18 and providing power to the perforating gun 14 using the running string 20. The wellbore 16 is drilled to access a formation from a surface of the well 10. The perforating gun 14 also includes a detonator 22 and a plurality of explosives 24 within an internal diameter (ID) of a main body 26 or on the outside of the main body 26. The main body 26 is a casing of the perforating gun 14 that houses the explosives 24 and engages with the detonator 22. The detonator 22 comprises a circuit communicably coupled with a power cable, which can also be part of the running string 20, and the explosives 24. The circuit comprises a mechanical shunt which can be automatically moved between a default closed position and an open position. The mechanical shunt automatically defaults to the closed position when the detonator is not loaded into the perforating gun 14. The mechanical shunt automatically creates an open switch in response to interaction with an engagement member of the perforating gun 14. The engagement member can be in some situations be an actuator, a tab, or other protruding structure on the perforating gun 14. Once an open switch is created, power can be provided to the detonator circuit in which case the explosives 24 are ignited and perforations 28 in well casing 30 and a subterranean formation 11 are created, in order to provide fluid communication with the earth formation. However, in some operations well 10 may not be cased. In an open-hole operation, the perforating gun 14 may be used to perforate other pipes or tubing downhole.

Figure 3A:
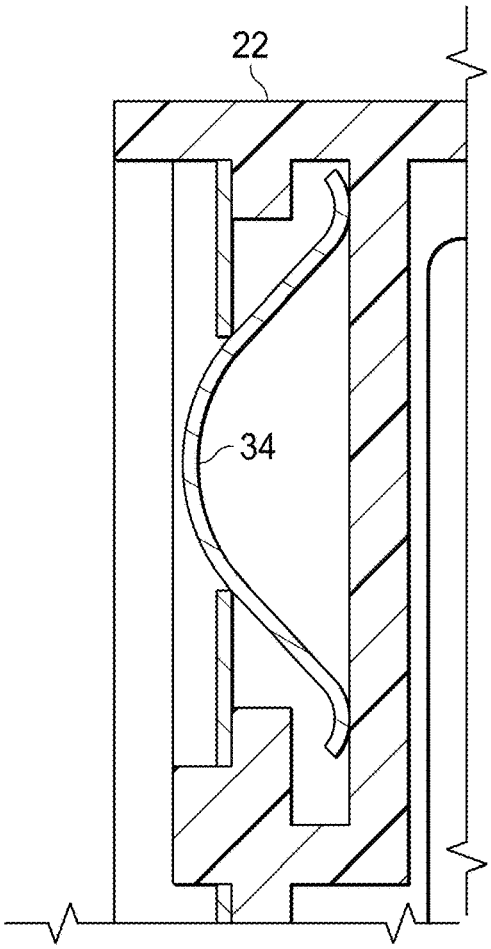
FIG. 3A is an illustration is the detonator circuit having a mechanical shunt in a default closed position, in accordance with certain example embodiments.
Figure 3B:
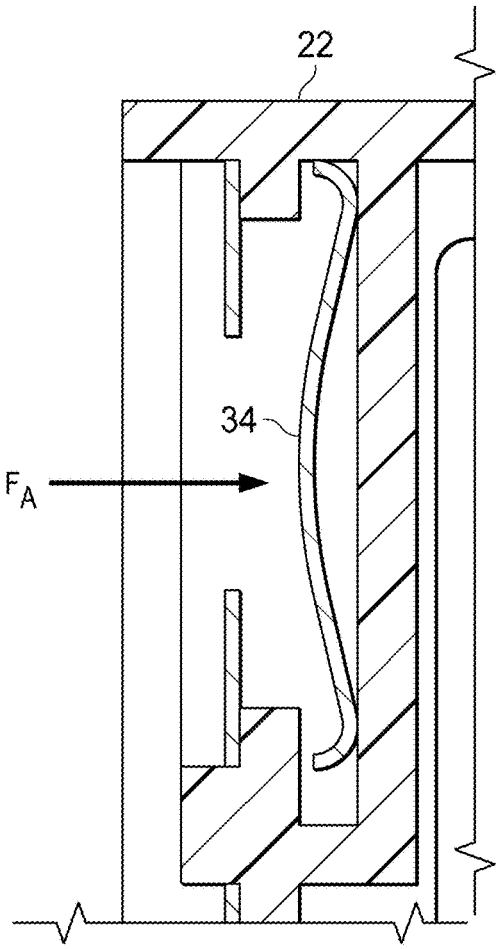
FIG. 3B is an illustration of the detonator and the mechanical shunt in an open position, in accordance with certain example embodiments.
Figure 3C:
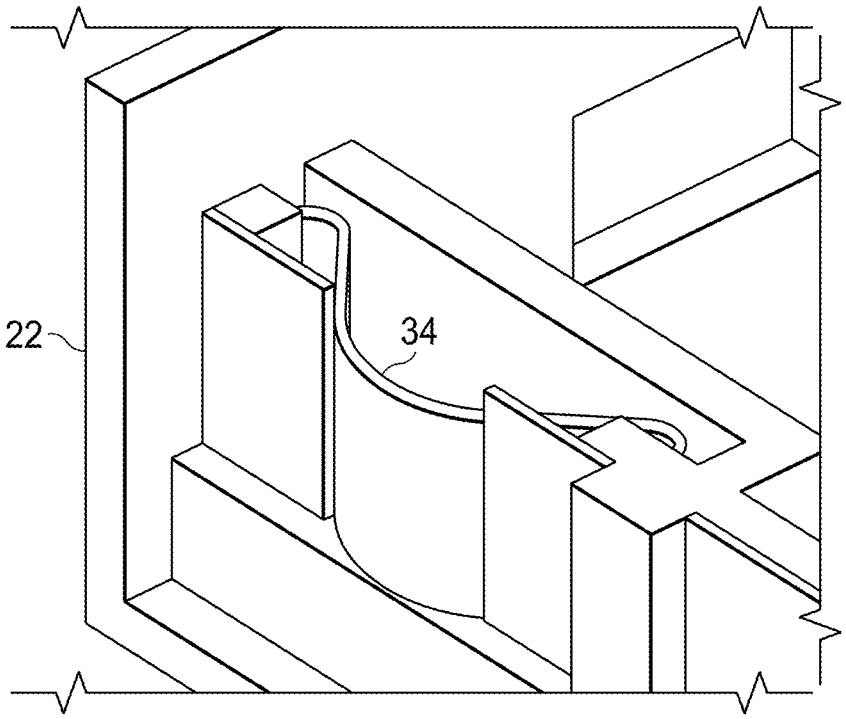
FIG. 3C is an illustration of an isometric view of the mechanical shunt in a closed position, in accordance with certain example embodiments.
Figure 3D:
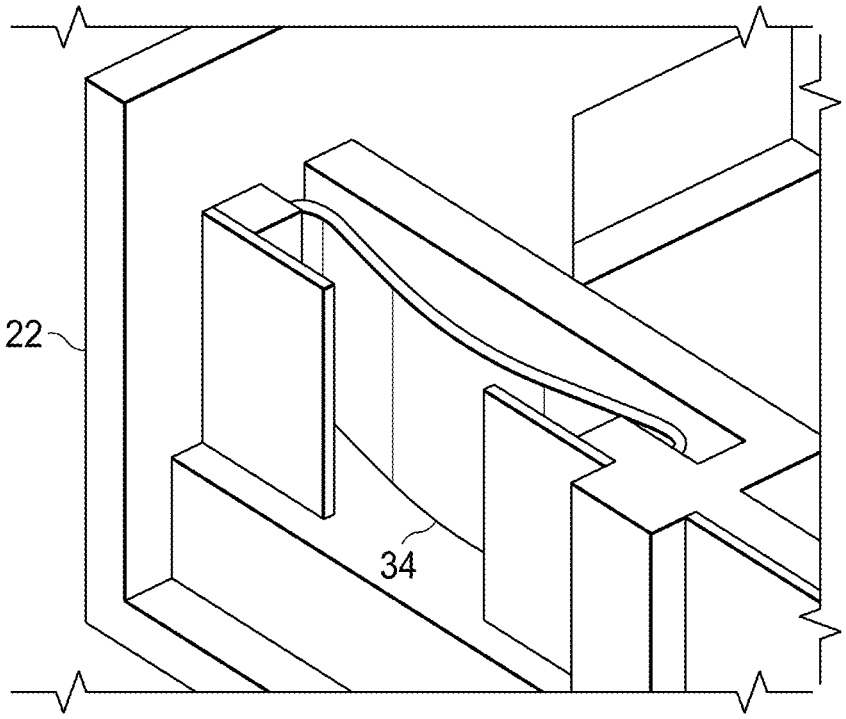
FIG. 3D is an illustration of an isometric view of the mechanical shunt in an open position, in accordance with certain example embodiments.
Figure 4A:
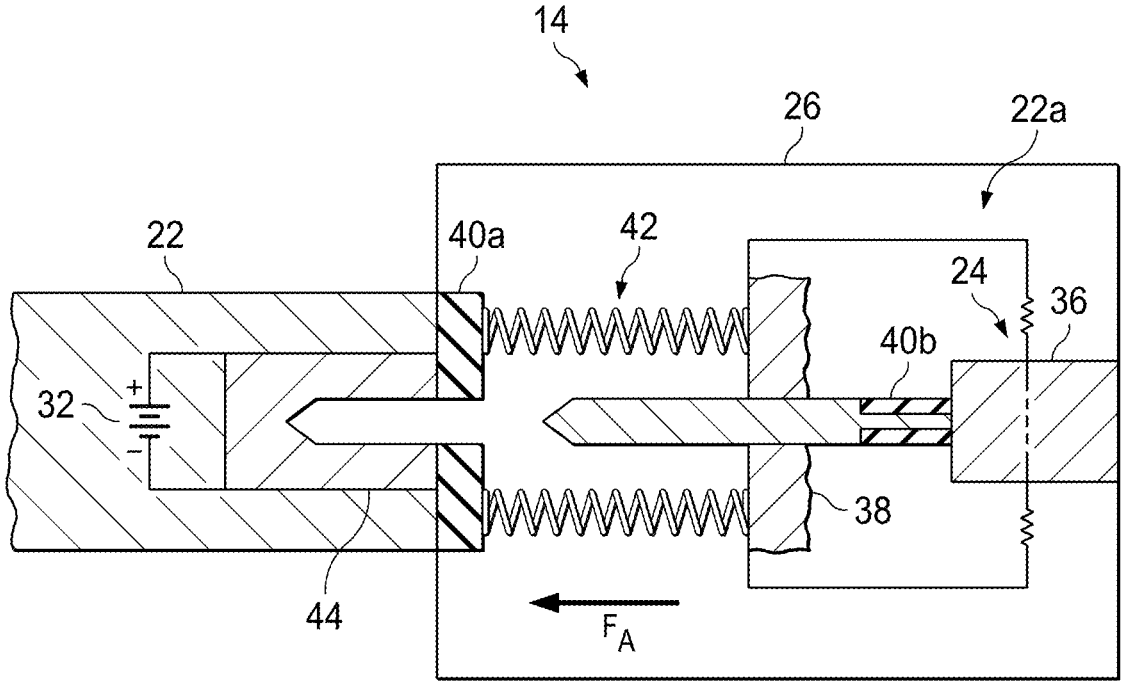
FIG. 4A is an illustration of a the perforating gun and the detonator with an alternative mechanical shunt configuration, in accordance with certain example embodiments.

A closed switch in the context of the detonator circuit is a circuit that may provide minimal or no resistance to draw current away from the explosives 24 thereby preventing ignition or detonation, as further detailed with respect to FIGS. 2-4. Additionally, a closed switch may include non-conductive paths created in a circuit, such as further detailed with respect to FIG. 4A. An open switch is a circuit that may provide enough resistance for power from the power source to energize the energetic material. The open switch can function to create a circuit with enough resistance to cause current flow through another circuit, such as further detailed with respect to FIGS. 2-4. Additionally, the open switch can function to create a conductive path in a circuit, such as further detailed with respect to FIG. 4A. Although a power cable that delivers power from the surface to the detonator 22 is disclosed, it should be understood that the power source can be part of the detonator 22 or perforating gun 14. In that particular embodiment, the power source can be triggered by a radio signal or a timer. A default mode of power as used herein may be one in which the power source is not immediately enabled to deliver power from a source to a circuit until the default mode is changed to an active mode. An active mode may be one in which power is delivered from a source to a circuit. A circuit in this specification may include any electrically conductive path and may be used to selectively initiate the ignition of energetic material. An engagement member, as described herein, may include a device that can manipulate the position of a mechanical shunt. A mechanical shunt, as disclosed herein, may include electrically conductive path that may themselves (or the surrounding structure carrying the conductive path) be physically manipulated to selectively open, close, or otherwise controllably change the electrical circuit. For example, a mechanical shunt may have electrical paths with resilient, or spring like, properties that can be held in one position in response to an applied force and automatically return to a default position in response to the removal of that force. The force ($F_A$), as described herein, is the amount of force needed to displace a spring enough to cause current to flow through different paths. The mechanical shunt can have different shapes, as will be discussed below in references to FIGS. 3 and 4. Perforating gun 14 is for creating perforations in the well casing 28 and earth formation. However, any operation using a jarring tool, wherein explosives are detonated downhole to create a jarring effect on a tool string is applicable. In essence, the detonator 22 can be used with any device that requires the safe transportation or storage of the energetic material.

Figure 2A:
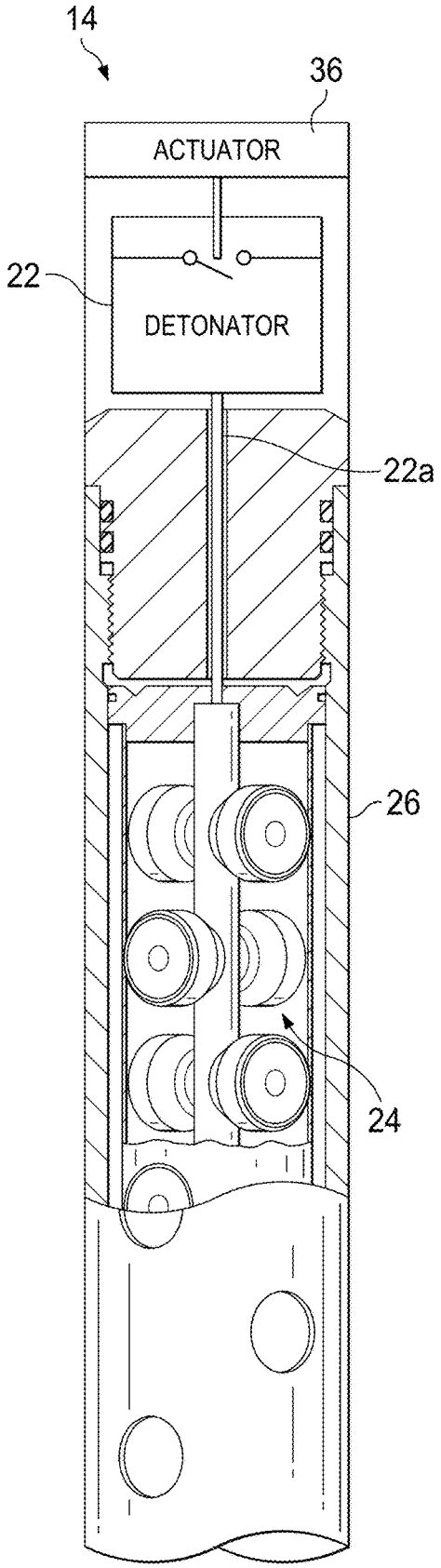
FIG. 2A is an illustration of a partial cut-away view of a configuration of a perforating gun and detonator, in accordance with certain example embodiments.

Referring now to FIG. 2A, illustrated is a partial cut-away view of an example configuration of the perforating gun 14 with detonator 22, according to certain example embodiments. The perforating gun 14, in an assembled state, comprises the detonator 22, a main body 26 having a plurality of bores, and an engagement member 36. The detonator 22 comprises a detonator circuit 22*a* having a mechanical shunt and explosives 24. When the detonator 22 is engaged with the perforating gun 14 and the engagement member 36 is in communication with the mechanical shunt of the detonator circuit 22*a* with enough force $F_A$ applied thereto, the mechanical shunt is moved to an open position. In some embodiments, the engagement member 36 may be a part of the detonator 22. As an example, the embodiment of FIG. 2A may not include the engagement member 36 but rather the engagement member 36 may be a part of circuit 22*a*. In other words, when the detonator 22*a* is engaged with the body 26 of the perforating gun 14, the circuit 22*a* can move in response causing the mechanical shunt to open. As previously stated, when the mechanical shunt is in the open position, the explosives 24 can be ignited. When the detonator is not engaged with the perforating gun 14, a mechanical shunt of the circuit is in a closed position, which prevents current from flowing to the explosives 24.

Figure 2B:
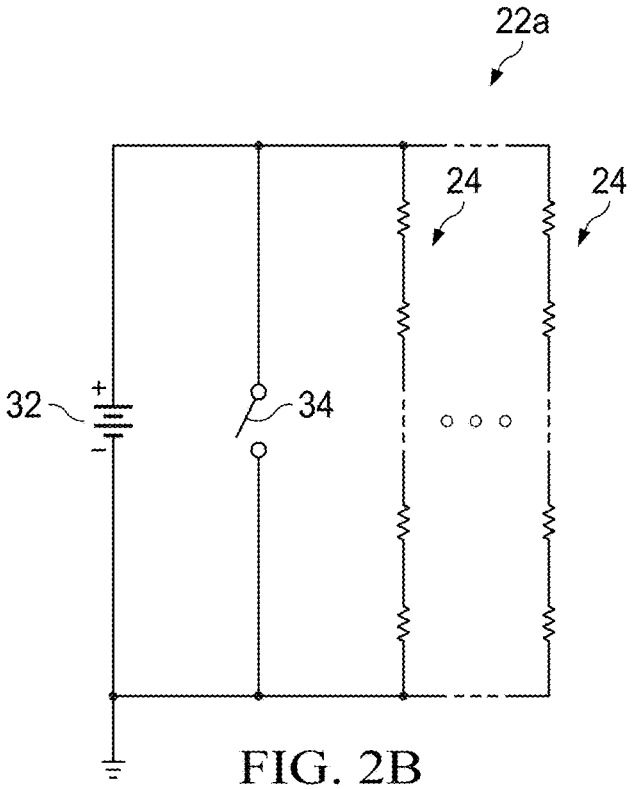
FIG. 2B is an illustration of a detonator circuit for use with the detonator, in accordance with certain example embodiments.

Referring now to FIG. 2B, illustrated is a detonator circuit 22*a*, according to certain example embodiments. The detonator circuit 22*a* comprises a source of power 32, a mechanical shunt 34, and explosives 24. In this particular embodiment, the detonator circuit 22*a* is arranged in a parallel configuration, although other configurations are possible. The actual power from the source of power 32 may come from a remote source delivered over a power cable coupled with the remaining part of the circuit of the detonator 22. Also, the source of power 32 may be in the form of a radio or time controlled battery that is a part of the perforating gun 14 or detonator 22.

Referring now to FIG. 3A, illustrated is detonator 22 and mechanical shunt 34 in a default closed position, according to certain example embodiments. When the detonator 22 is not engaged with the perforating gun 14, the shunt 34 is in a default closed position, which provides an alternative closed circuit, to the circuit containing the explosives 24. This prevents the energetic material from being ignited by the power source 32. In this configuration, the detonator 22, which includes the detonator circuit 22*a* and explosives 24 can be safely transported.

Referring now to FIG. 3B, illustrated is detonator 22 and mechanical shunt 34 in an open position, according to certain example embodiments. Once the detonator 22 is engaged with the perforating gun 14, the shunt 34 is manipulated into the open position. At this point, current from the power source 32, which may be controlled by a user at the surface of the well or activated through radio signals or timer activated, can be delivered to the explosives 24. After use, the detonator 22, which includes the detonator circuit 24 and explosives, can be removed from the perforating gun 14 and the shunt 34 returns to the default closed position, ready for safe transportation. [You don't know if everything went right or not. Maybe not all explosives ignited.]

Referring now to FIG. 3C, illustrated is an isometric view of the mechanical shunt 34 of FIG. 3A in a closed position, according to certain example embodiments. The detonator 22 includes the detonator circuit 22*a* having the mechanical shunt 34. The body of the detonator 22 can include conductive material used to form the detonator circuit 22*a*. In this state, the detonator 22 can be safely transported.

Referring now to FIG. 3D, illustrated is an isometric view of the mechanical shunt 34 of FIG. 3B in an open position, according to certain example embodiments. In this state, the explosives 24 of the detonator circuit 22 can be ignited. In order for the detonator 22 to enter this state, the mechanical shunt 34 must be manipulated into the position.

Referring now to FIG. 4A, illustrated is perforating gun 14 and detonator 22 having an alternative shunt configuration, according to certain example embodiments. The detonator 22 comprises a male conductor 38 coupled to the explosives 24, to an insulator 40*a* through a spring 42, and to the engagement member 36 through another insulator 40*b*. The detonator 22 further includes a female conductor 44 coupled with the power source 32. Again, the detonator 22 and main body 26 are pieces that can be separated for transport purposes and coupled together for operational purposes. The circuit 22*a* includes non-conductive paths and, therefore, the circuit 22*a* cannot ignite the explosives 24. Once the detonator 22 engages with the actuator 36 of the perforating gun 26, the force $F_A$ created by the engagement member 36 on the male conductor 38 displaces the spring 42 enough so that the male conductor 38 and the female conductor 44 engage and the circuit 22*a* is completed. At this point, power from the power source 32 can be provided and the explosives 24 ignited.

Figure 4B:
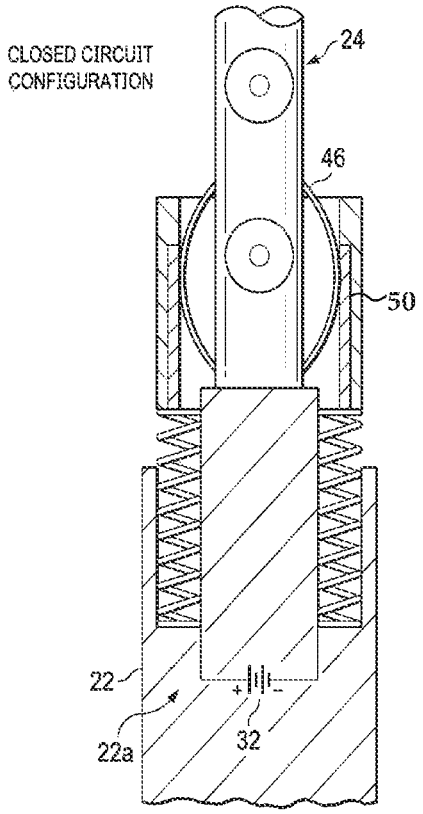
FIG. 4B is an illustration of the detonator having a detonator circuit with an alternative mechanical shunt configuration where the mechanical shunt is in a closed circuited configuration, in accordance with certain example embodiments.

Referring now to FIG. 4B, illustrated is the detonator 22 having a detonator circuit 22*a* with an alternative mechanical shunt configuration where the mechanical shunt is in a closed circuited configuration, according to certain example embodiments. The detonator 22 comprises a spring 42, conductive element 46 having a ground, and the detonator circuit 22*a*. The detonator circuit 22*a* comprises a mechanical shunt 50 and the explosives 24 arranged on a shaft. In this state, current from the power source 32 is conducted away from the explosives 24, through the shunt 50, the conductive element 46, and back to the power source 32. In essence, the conductive element 46 prevents current forming on a part of the circuit 22*a* coupling the explosives 24 together and with the power source 32.

Figure 4C:
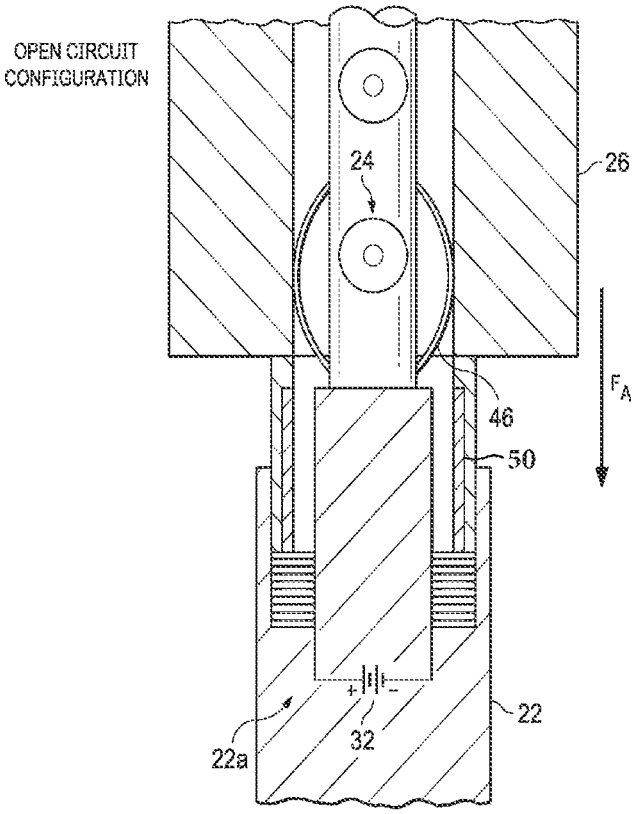
FIG. 4C is an illustration of the detonator having the detonator circuit with the mechanical shunt in the open circuit configuration, in accordance with certain example embodiments.

Referring now to FIG. 4C, illustrated is the detonator 22 having a detonator circuit 22*a* with the mechanical shunt 50 in the open circuit configuration, according to certain example embodiments. In this state, the detonator 22 is engaged with the body 26 of the perforating gun 14 causing the spring 42 to compress. When compressed, contact between the shunt 50 and the conductive element 46 is removed and contact between the body 26, shunt 50, and part of the circuit 22*a* coupling the explosives 24 together and with the power source 32 is established. The shunt 50 and the body 26 form a conductive path with ground that allows current to form on the part of the circuit 22*a* coupling the explosives 24 together and with the power source 32.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, a detonator for controlling activation of an energetic material, the detonator comprising: a mechanical switch coupled to a power source and the energetic material, the mechanical switch creates a default closed switch between the power source and the energetic material, communicates with an actuator in response to engaging a gun assembly, and creates an open switch in response to communicating with the actuator;

Clause 2, the detonator of clause 1, wherein the energetic material comprises a plurality of explosives arranged in a pattern with respect to the internal diameter of the gun assembly;

Clause 3, the detonator of clause 1, wherein the energetic material comprises a plurality of explosives arranged in one selected from a group comprising a circumferential pattern and stacked pattern with respect to the internal diameter of the gun assembly;

Clause 4, the detonator of clause 1, wherein the mechanical switch is one selected from a group comprising: in parallel and series with the power supply; and in parallel and series with the energetic material;

Clause 5, the detonator of clause 1, wherein the mechanical switch creates: a short circuit in response to the mechanical switch configured to the default closed switch; and an open circuit in response to the mechanical switch configured to the open switch;

Clause 6, the detonator of clause 1, wherein the energetic material is activated in response to the mechanical switch forming an open switch and power provided by the power source;

Clause 7, the detonator of clause 1, wherein the mechanical switch returns to the default closed switch in response to disengaging from the gun assembly;

Clause 8, a gun for controlling activation of an energetic material, the gun comprising: a gun assembly; a mechanical switch coupled to a power source and the energetic material, the mechanical switch creates a default closed switch between the power source and the energetic material, communicates with an actuator in response to engaging a gun assembly, and creates an open switch in response to communicating with the actuator;

Clause 9, the gun of clause 8, wherein the energetic material comprises a plurality of explosives arranged in a pattern with respect to the internal diameter of the gun assembly;

Clause 10, the gun of clause 8, wherein the energetic material comprises a plurality of explosives arranged in one selected from a group comprising a circumferential pattern and stacked pattern with respect to the internal diameter of the gun assembly;

Clause 11, the gun of clause 8, wherein the mechanical switch is one selected from a group comprising: in parallel and series with the power supply; and in parallel and series with the energetic material;

Clause 12, the gun of clause 8, wherein the mechanical switch: a short circuit in response to the mechanical switch configured to the default closed switch; and an open circuit in response to the mechanical switch configured to the open switch;

Clause 13, the gun of clause 8, wherein the energetic material is activated in response to the mechanical switch forming an open switch and power is provided by the power source;

Clause 14, the gun of clause 8, wherein the mechanical switch returns to the default closed switch in response to disengaging from the gun assembly;

Clause 15, a method for controlling activation of an energetic material, the method comprising: loading a detonator into a gun assembly; placing the gun assembly in a downhole wellbore environment; and providing power to the detonator; a mechanical switch coupled to a power source and the energetic material, the mechanical switch creates a default closed switch between the power source and the energetic material, communicates with an actuator in response to engaging a gun assembly, and creates an open switch in response to communicating with the actuator;

Clause 16, the method of clause 15, wherein the energetic material comprises a plurality of explosives arranged in a pattern with respect to the internal diameter of the gun assembly;

Clause 17, the method of clause 15, wherein the energetic material comprises a plurality of explosives arranged in one selected from a group comprising a circumferential pattern and stacked pattern with respect to the internal diameter of the gun assembly;

Clause 18, the method of claim 15, wherein the mechanical switch is one selected from a group comprising: in parallel and series with the power supply; and in parallel and series with the energetic material;

Clause 19, the method of clause 15, further comprising creating a short circuit in response to the mechanical switch configured to the default closed switch, and an open circuit in response to the mechanical switch configured to the open switch; and Clause 20, the method of clause 15, further comprising returning to the default closed switch in response to disengaging from the gun assembly.

What is claimed is:

1. A detonator for controlling activation of an energetic material, the detonator comprising:

a mechanical shunt actionable between a default closed position, and an open position, the shunt in the default closed position is electrically connected with a power source and completes first circuit that prevents power from being supplied to an energetic material as a fail-safe feature comprising a closed switch state with the power source, the shunt in the open position is electrically disconnected from the power source, removes the fail-safe feature, creates an open switch state with the power source that completes a second circuit connecting the power source and the energetic material and supplying power to the energetic material, wherein the mechanical shunt is a conductive material in a concave shape held in the default closed position with stored strain energy;

wherein the mechanical shunt is configured to communicate with an actuator in response to engaging a gun assembly and move from the default closed position to the open position in response to communicating with the actuator; wherein communicating with the actuator comprises reducing the curvature of the mechanical shunt such that it shifts to the open position.

2. The detonator of claim 1, wherein the energetic material comprises a plurality of explosives arranged in a pattern with respect to the internal diameter of the gun assembly.

3. The detonator of claim 1, wherein the energetic material comprises a plurality of explosives arranged in one selected from a group comprising a circumferential pattern and stacked pattern with respect to the internal diameter of the gun assembly.

4. The detonator of claim 1, wherein the mechanical shunt coupled to the power source, is in series with the energetic material or is in parallel with the energetic material.

5. The detonator of claim 1, wherein the mechanical shunt creates: a short circuit in response to the mechanical shunt configured to the default closed switch state; and an open circuit in response to the mechanical shunt configured to the open switch state.

6. The detonator of claim 1, wherein the energetic material is activated in response to the mechanical shunt forming an open switch and power provided by the power source.

7. The detonator of claim 1, wherein the mechanical shunt comprises resilient spring like properties, is held in the open position by an applied force, and automatically returns to the default closed position in response to the removal of the applied force.

8. A gun for controlling activation of an energetic material, the gun comprising:

a gun assembly; and a mechanical shunt actionable between a default closed position, and an open position, the shunt in the default closed position is electrically connected with a power source and completes a first circuit that prevents power from being supplied to an energetic material as a fail-safe feature comprising a closed switch state with the power source, the shunt in the open position is electrically disconnected from the power source, removes the fail-safe feature, creates an open switch state with the power source, and completes a second circuit connecting the power source and the energetic material and supplying power to the energetic material, wherein the mechanical shunt is a conductive material in a concave shape held in the default closed position with stored strain energy;

wherein the mechanical shunt is configured to communicate with an actuator in response to engaging a gun assembly and move from the default closed position to the open position in response to communicating with the actuator; wherein communicating with the actuator comprises reducing the curvature of the mechanical shunt such that it shifts to the open position.

9. The gun of claim 8, wherein the energetic material comprises a plurality of explosives arranged in a pattern with respect to the internal diameter of the gun assembly.

10. The gun of claim 8, wherein the energetic material comprises a plurality of explosives arranged in one selected from a group comprising a circumferential pattern and stacked pattern with respect to the internal diameter of the gun assembly.

11. The gun of claim 8, wherein the mechanical shunt, coupled to the power source, is in series with the energetic material or is in parallel with the energetic material.

12. The gun of claim 8, wherein the mechanical shunt creates: a short circuit in response to the mechanical shunt configured to the default closed switch state; and an open circuit in response to the mechanical shunt configured to the open switch state.

13. The gun of claim 8, wherein the energetic material is activated in response to the mechanical shunt forming the open switch state and power is provided by the power source.

14. The gun of claim 8, wherein the mechanical shunt comprises resilient spring like properties, is held in the open position by an applied force, and automatically returns to the default closed position in response to the removal of the applied force.

15. A method for controlling activation of an energetic material, the method comprising:

loading a detonator into a gun assembly;

placing the gun assembly in a downhole wellbore environment; and providing power to the detonator;

providing a mechanical shunt that is actionable between a default closed position, and an open position; wherein the mechanical shunt is a conductive material in a concave shape held in the default closed position with stored strain energy;

electrically connecting the shunt, in the default closed position, with a power source and completing a first circuit that prevents power from being supplied to an energetic material as a fail-safe feature comprising a closed switch state with the power source;

electrically disconnecting the shunt, in the open position, from the power source, removing the fail-safe feature, creating an open switch state with the power source, and completing a second circuit connecting the power source and the energetic material and supplying power to the energetic material; and configuring the mechanical shunt to communicate with an actuator in response to engaging a gun assembly and to move from the default closed position to the open position in response to communicating with the actuator; wherein communicating with the actuator comprises reducing the curvature of the mechanical shunt such that it shifts to the open position.

16. The method of claim 15, wherein the energetic material comprises a plurality of explosives arranged in a pattern with respect to the internal diameter of the gun assembly.

17. The method of claim 15, wherein the energetic material comprises a plurality of explosives arranged in one selected from a group comprising a circumferential pattern and stacked pattern with respect to the internal diameter of the gun assembly.

18. The method of claim 15, wherein the mechanical shunt, coupled to the power source, is in series with the energetic material or is in parallel with the energetic material.

19. The method of claim 15, further comprising creating a short circuit in response to the mechanical shunt configured to the default closed switch state, and an open circuit in response to the mechanical shunt configured to the open switch state.

20. The method of claim 15, further comprising the mechanical shunt having resilient spring like properties, holding the shunt in the open position in response to an applied force, and automatically returning the shunt to the default closed position in response to the removal of the applied force.

* * * * *